United States Patent [19]

Pontoppidan

[11] 4,298,548

[45] Nov. 3, 1981

[54] CARBURETORS FOR INTERNAL COMBUSTION ENGINES

[75] Inventor: Michael Pontoppidan, Chatou, France

[73] Assignee: S.I.B.E. Societe Industrielle de Brevets et d'Etudes, Neuilly sur Seine, France

[21] Appl. No.: 146,158

[22] Filed: May 2, 1980

[30] Foreign Application Priority Data

May 11, 1979 [FR] France ..... 79 12124

[51] Int. Cl.[3] ..... F02M 7/12

[52] U.S. Cl. ..... 261/34 R; 261/121 A

[58] Field of Search ..... 261/121 A, 34 R

[56] References Cited

U.S. PATENT DOCUMENTS

| | | | |
|---|---|---|---|
| 3,738,336 | 6/1973 | Holland | 261/DIG. 68 |
| 3,810,606 | 5/1974 | Masaki | 261/121 B |
| 4,020,859 | 5/1977 | Malphettes et al. | 261/72 R |
| 4,092,380 | 5/1978 | Pierlot et al. | 261/121 B |
| 4,099,492 | 7/1978 | Asaka | 261/121 B |

FOREIGN PATENT DOCUMENTS

| | | | |
|---|---|---|---|
| 579434 | 7/1959 | Canada | 261/34 R |
| 1081900 | 12/1954 | France | 261/121 A |
| 2355170 | 1/1978 | France . | |

*Primary Examiner*—Tim R. Miles

*Attorney, Agent, or Firm*—John T. Synnestvedt; Richard D. Weber

[57] ABSTRACT

In a carburetor the fuel jet system opening into the intake pipe of the engine comprises an emulsion well supplied with air and fuel and a device for correcting the fuel/air ratio of the mixture supplied to the engine as a function of the amplitude of the alternating pressure variations caused by the suction of the engine in the intake pipe. The correcting device comprises a movable wall defining a chamber which communicates with the emulsion well and to which the alternating pressure variations are applied through an attenuator. The device adjusts the depression in the emulsion well for increasing or reducing the amplitude of the alternating component of the pressure which is communicated thereto from the opening of the fuel jet system according as to whether the acoustic matching of the carburetor-engine manifold assembly tends to produce an excessive or insufficient fuel/air ratio under high load.

5 Claims, 3 Drawing Figures

CARBURETORS FOR INTERNAL COMBUSTION ENGINES

BACKGROUND AND SUMMARY OF THE INVENTION

The present invention relates to carburetors for internal combustion engines of the kind comprising a fuel jet system opening into the intake pipe of the engine and comprising an emulsion well supplied with air and fuel and a device for correcting the fuel/air ratio of the mixture supplied to the engine as a function of the amplitude of the alternating pressure variations caused by the suction of the engine in the intake pipe.

By nature, the intake of a piston spark ignition engine is subjected to pulsating operating conditions due to the alternating movement of the pistons; the pulsating operating conditions are particularly noticeable in modern engines in which the closure of the inlet valves takes place with considerable delay; it is also very noticeable in engines having a small number of cylinders, typically flat-twin engines. When such a motor is under a high load, the throttle of the carburetor is widely open.

The pulsed depression is applied directly to the fuel jet system, which opens upstream of the throttle. The result is operating anomalies. Depending on the geometrical configuration of the carburetor-manifold assembly, the acoustical matching of which is not easily controllable, the air-fuel mixture supplied to the engine may be to lean or too rich.

Different remedies have been proposed for countering the pulsatory phenomenon effects. French patent No. 2,355,170 corresponding to U.S. Pat. No. 4,092,380, describes a carburetor in which the correcting device meters the vacuum prevailing above the fuel as a function of the alternating component of the depression which is applied thereto. That device gives satisfactory results, but is often costly to put into practice; the particular embodiment described in that prior patent requires a system of valves for subjecting a diaphragm to a differential pressure depending on the alternating component of the depression in the intake pipe.

It is an object of the invention to provide a carburetor having an improved correction device. It is a more particular object to provide a carburetor having such a device which is of low cost and whose correction may be easily adapted to suit the requirements of different types of engine.

According to the invention, there is provided a carburetor of the above defined type, in which the correcting device comprises a movable wall defining a chamber which communicates with the emulsion well and to which the alternating pressure variations are applied through attenuating means, whereby the device adjusts the depression in the emulsion well for increasing or reducing the amplitude of the alternating component of the pressure which is communicated thereto from the opening of the fuel jet system, according as to whether the acoustic matching of the carburetor engine manifold assembly tends to produce for high charges of the engine an excessive or insufficient fuel/air ratio.

In such a carburetor, the direct action of the pulses at the opening of the jet system is counterbalanced by an indirect action exerted on the emulsion well and which may be adapted to the characteristics of the particular carburetor-manifold assembly.

In a first embodiment of the invention, the movable wall constitutes a partition separating a capacity into said chamber communicating with the emulsion well and an additional chamber connected to the venturi of the carburetor.

In another embodiment, said chamber constitutes a damping capacity located above said fuel emulsion well and communicating with an emulsion tube placed in the emulsion well through a calibrated restrictor, said capacity communicating with the air inlet of the carburetor through a calibrated passage and being separated from the atmosphere by said movable wall.

The invention will be better understood from the description which follows of down-draught carburetors fitted with correction devices and constituting particular embodiments of the invention, given by way of examples.

SHORT DESCRIPTION OF THE DRAWINGS

Figure 1:
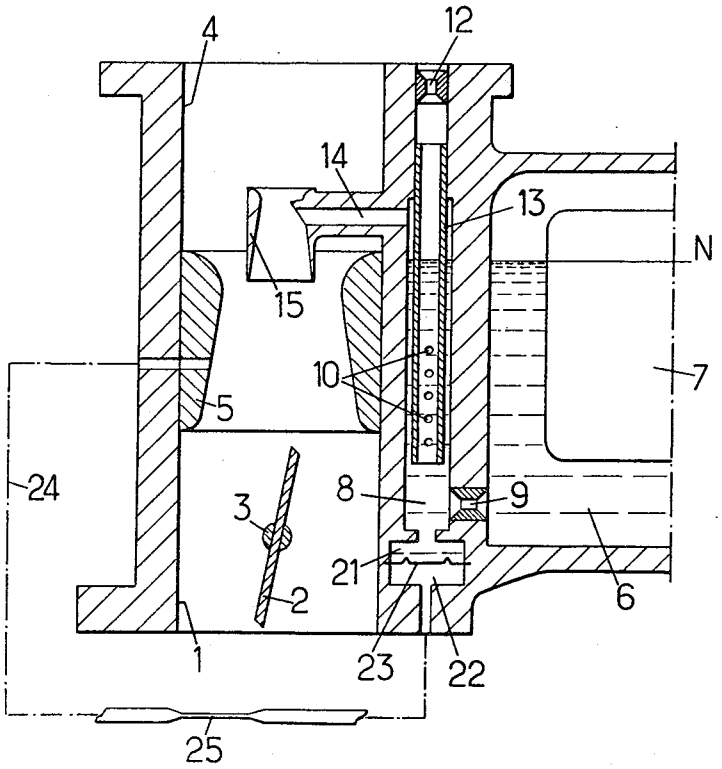
FIG. 1 shows schematically in section a carburetor whose throttle member is wide open (which corresponds to the full charge of the engine) provided with a correcting device tending to render the mixture supplied to the engine leaner when the amplitude of the pulses increases, usable when the carburetor-manifold system is such that the pulses tend to enrich the mixture.
Figure 3:
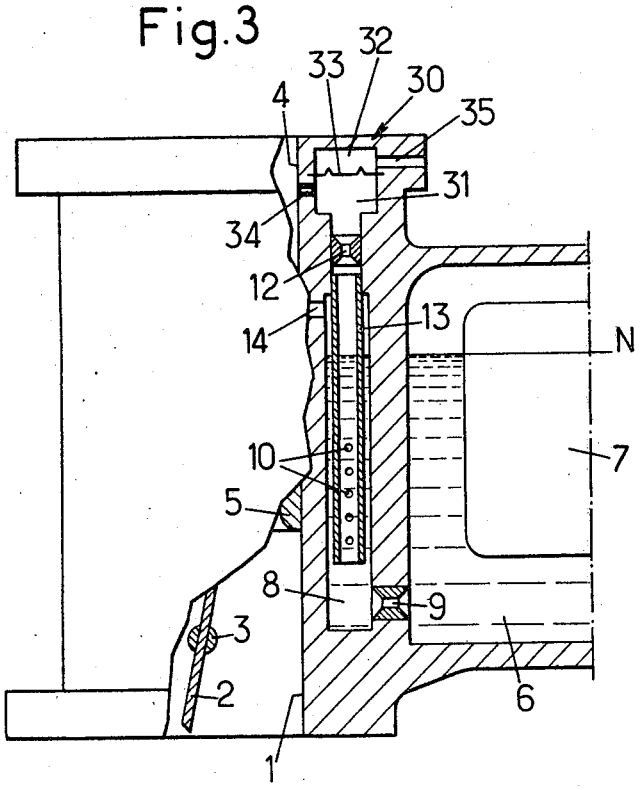

FIG. 3, similar to FIG. 1, shows schematically a variation of the correcting device.

DESCRIPTION OF PARTICULAR EMBODIMENTS

The down-draught carburetor shown in FIG. 1 comprises an intake pipe 1 fitted with a throttle member 2, formed by a butterfly valve fixed on a pin 3 actuated by the driver. The pipe is provided with an air input 4 protected by an air filter (not shown) and a main venturi 5 in which emerges a main air/fuel emulsion jet system, supplied with fuel from a float chamber 6. Chamber 6 contains a float 7 actuating a fuel admission needle (not shown) so as to maintain the free surface of the fuel substantially permanently at level N.

The main jet system shown comprises: an emulsion well 8 supplied with fuel from chamber 6, through a main jet 9; an emulsion tube 13, having in its lower part perforations 10 plunging into the well 8 so as to take fuel therefrom and mix it with the emulsion air coming from the air input 4 of the carburetor and arriving in a channel provided with a calibrated orifice 12; and a channel 14 taking the air-fuel mixture from the upper part of well 8 and conveying it inside a secondary venturi 15 from where it emerges into the intake pipe in the vicinity of the throat of the main venturi 5.

Figure 2:
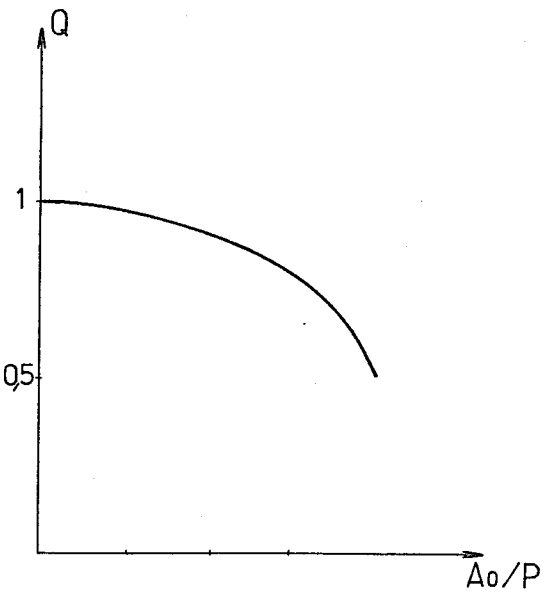
FIG. 2 is a curve representative of the variation of the fuel flow Q as a function of the relationship between the amplitude Ao of the alternating component of the pressure prevailing in the well and the average value P of the pressure in the intake pipe.

The invention uses the fact that the pulses exerted in the emulsion well have an action on the fuel flow of the kind shown in FIG. 2. It can be seen that the fuel flow Q varies inversely to the ratio Ao/P between the amplitude of the alternating component Ao of the pressure and the average value P of the latter.

In the embodiment shown in FIG. 1, corresponding to a carburetor-manifold assembly whose acoustic matching is such that for a high load of the engine a tendency to excessive enrichment can be observed, the correcting device must tend to render the mixture leaner.

For reducing the fuel flow, the value of the pulses prevailing in well 8 must be increased; this result is attained by transmitting into the well the high amplitude pulses prevailing in venturi 5 through a pipe 24, a chamber 22, a diaphragm 23 forming a movable wall and a chamber 21.

An additional correction, possibly depending on the speed, may be made by disposing an adjustable attenuating element in pipe 24; this element is typically a capillary tube 25 disposed in pipe 24 and whose characteristics will be chosen with a view to suitable matching with the carburetor.

In the embodiment of FIG. 3, the correcting device is provided to counter the leaning action of the transmission of the pulses (at the opening into venturi 15) to well 8. For that, there is provided, above emulsion tube 13 and the calibrated orifice 12, a damping capacity 30 comprising two chambers 31 and 32 separated from each other by a flexible diaphragm 33; chamber 31, in direct relation with the jet system, communicates with the air input 4 of the carburetor through a calibrated passage 34; chamber 32 is connected to a zone at atmospheric pressure through a passage 35.

As a variation, the flexible diaphragm may be replaced by a movable wall.

The capacity attenuates the amplitude of the pulses transmitted into the emulsion well; this result may be obtained with a small capacity because of the low acoustic velocity. There results an increase in fuel flow in relation to that which would exist in the absence of the device, as appears from the data illustrated by FIG. 2. The increase in fuel/air ratio which is obtained when jet 9 and orifice 12 are properly sized compensate at least partially the decrease in fuel/air ratio due to the acoustic matching of the carburetor-manifold assembly.

I claim:

1. A carburetor for an internal combustion engine comprising a fuel jet system opening into the intake pipe of the engine and comprising an emulsion well, an air path of invariable flow area for supplying atmospheric air to said wall, jetting means for supplying fuel to said well, and a device for correcting the fuel/air ratio of the mixture supplied to the engine as a function of the amplitude of the alternating pressure variations caused by the suction of the engine in the intake pipe, wherein the correcting device comprises a movable wall defining a chamber which communicates with the emulsion well and attenuating means through which the alternating pressure variations are applied to said well, whereby the device controls the depression in the emulsion well to increase or reduce the amplitude of the alternating component of the pressure which is communicated thereto from the opening of the fuel jet system, according to whether the acoustic matching of the carburetor-engine manifold assembly tends to produce for high charges of the engine an excessive or insufficient fuel/air ratio.

2. A carburetor according to claim 1, wherein said movable wall is a deformable diaphragm.

3. A carburetor as claimed in claim 1, comprising a capacity, and wherein the movable wall constitutes a partition separating said capacity into said chamber communicating with the emulsion well and an additional chamber connected to the venturi of the carburetor.

4. A carburetor according to claim 3, wherein said attenuating means comprises a capillary tube in the connection between said additional chamber and the venturi.

5. A carburetor for an internal combustion engine comprising a fuel jet system opening into the intake pipe of the engine and comprising an emulsion well supplied with air and fuel and a device for correcting the fuel/air ratio of the mixture supplied to the engine as a function of the amplitude of the alternating pressure variations caused by the suction of the engine in the intake pipe, wherein the correcting device comprises a movable wall defining a chamber which communicates with the emulsion well and to which the alternating pressure variations are applied through attentuating means, whereby the device controls the depression in the emulsion well to increase or reduce the amplitude of the alternating component of the pressure which is communicated thereto from the opening of the fuel jet system, according to whether the acoustic matching of the carburetor-engine manifold assembly tends to produce for high charges of the engine an excessive or insufficient fuel/air ratio, wherein said chamber constitutes a damping capacity located above said fuel emulsion well and communicating with an emulsion tube placed in the emulsion well through a calibrated restrictor, said capacity communicating with the air inlet of the carburetor through a calibrated passage and being separated from the atmosphere by said movable wall.

* * * * *